US008919453B2

(12) United States Patent
He et al.

(10) Patent No.: US 8,919,453 B2
(45) Date of Patent: Dec. 30, 2014

(54) SCALLOPED LANDING RING

(75) Inventors: Henry He, Edmonton (CA); Kwong-Onn Chan, Edmonton (CA); Gene Ambrose, Calgary (CA)

(73) Assignee: Vetco Gray Inc., Houston, TX (US)

( * ) Notice: Subject to any disclaimer, the term of this patent is extended or adjusted under 35 U.S.C. 154(b) by 700 days.

(21) Appl. No.: 13/274,004

(22) Filed: Oct. 14, 2011

(65) Prior Publication Data

US 2013/0092397 A1 Apr. 18, 2013

(51) Int. Cl.

| | |
|---|---|
| ***E21B 23/00*** | (2006.01) |
| ***E21B 43/10*** | (2006.01) |
| ***E21B 33/03*** | (2006.01) |
| ***E21B 33/04*** | (2006.01) |
| ***E21B 33/05*** | (2006.01) |
| ***E21B 33/13*** | (2006.01) |

(52) U.S. Cl.

CPC ..... *E21B 33/03* (2013.01); *E21B 33/04* (2013.01); *E21B 33/05* (2013.01); *E21B 33/13* (2013.01)

USPC ..... 166/382; 166/75.14; 166/90.1

(58) Field of Classification Search

USPC ..... 166/382, 208, 379, 75.13, 75.14, 55.1, 166/86.1, 88.1, 97.1, 297, 90.1, 285, 242.1; 285/123.1

See application file for complete search history.

(56) References Cited

U.S. PATENT DOCUMENTS

| | | | | |
|---|---|---|---|---|
| 3,885,625 | A * | 5/1975 | Ahlstone | 166/181 |
| 3,903,965 | A * | 9/1975 | Ahlstone | 166/182 |
| 5,620,052 | A | 4/1997 | Turner | |
| 7,779,921 | B2 | 8/2010 | Cain et al. | |
| 2009/0032241 | A1 * | 2/2009 | Allen et al. | 166/72 |
| 2010/0089590 | A1 * | 4/2010 | Dyson et al. | 166/382 |
| 2011/0132624 | A1 | 6/2011 | Miller | |
| 2013/0092397 | A1 * | 4/2013 | He et al. | 166/382 |

OTHER PUBLICATIONS

GB Search Report and Opinion dated Jan. 28 2013 from corresponding Application No. GB1218275.4.

* cited by examiner

*Primary Examiner* — Daniel P Stephenson
(74) *Attorney, Agent, or Firm* — Bracewell & Giuliani LLP

(57) ABSTRACT

A landing ring having at least one scallop groove formed on an interior of the ring. The landing ring interfaces with a fluted mandrel casing hanger such that the scallop groove aligns between flutes of the hanger. This alignment of the scallop groove of the landing ring with the fluted mandrel casing hanger provides sufficient clearance to allow a stabbing in of a cement tube for cement injection during cement topping operations or debris clean out down hole.

18 Claims, 5 Drawing Sheets

Fig. 2
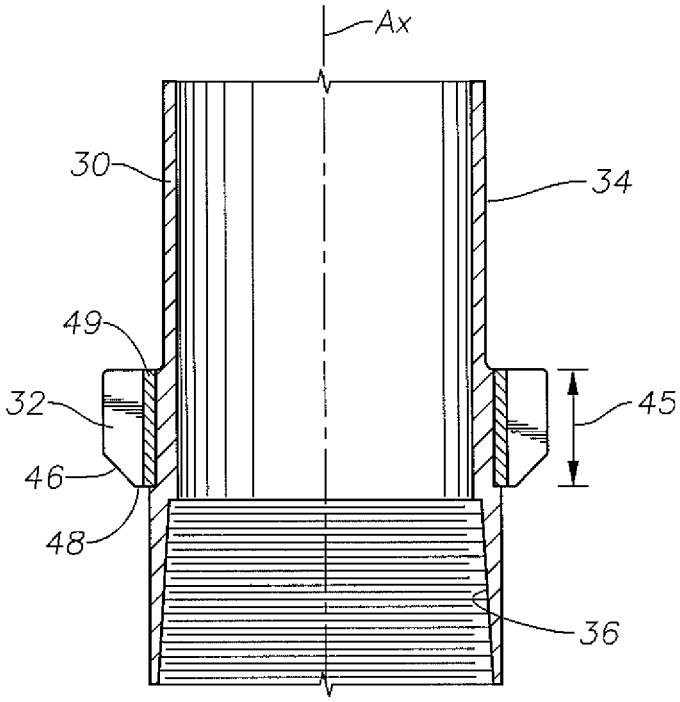
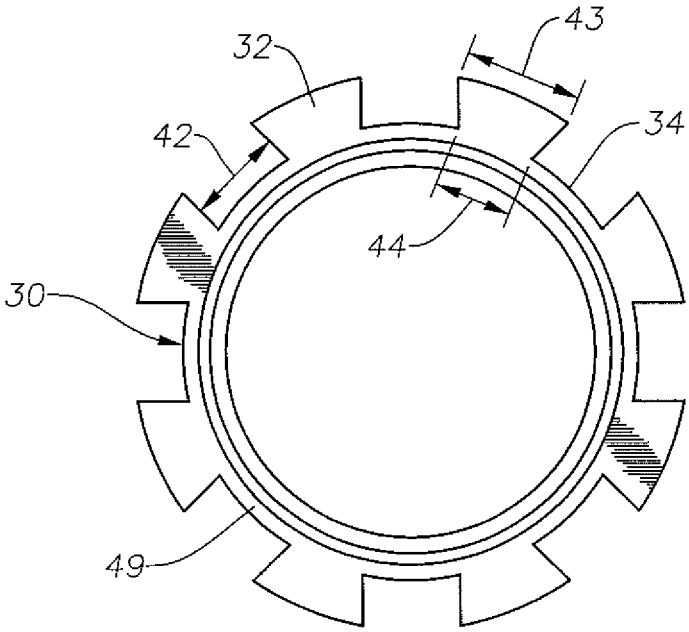
Fig. 3

SCALLOPED LANDING RING

FIELD OF THE INVENTION

This invention relates in general to oil and gas production equipment, and particularly to a scalloped landing ring used with a mandrel-type hanger in surface wells.

BACKGROUND OF THE INVENTION

One technique of surface or land wellhead production includes drilling a well bore on land and installing a string of conduit or casing in the well. The first string of conduit is typically referred to as conductor pipe that may be lowered near the surface into the well hole drilled into the formation. The conductor pipe is then typically cemented in place with an upper portion extending above the surface. The upper portion of the conductor pipe extending above the surface may be housed in a cellar constructed around the well bore. The outer diameter of the conductor pipe may be sealed against a cellar base. The conductor pipe is typically used to prevent the sides of the well bore from caving in. The conductor pipe may also be called a drive pipe that is typically short in length and sometimes driven into the ground.

Once additional well operations are required, such as installation of additional casing within the well, the upper portion of the conductor pipe is typically cut at a desired point and leveled off. A support or landing ring is then typically installed on top of the conductor pipe. The landing ring can receive a fluted mandrel hanger that may support casing in the wellhead and allow drilling fluids or cement, during cementing operations, to return upwards through the hanger's flutes. The landing ring and fluted mandrel hangers are commonly used in surface wells. After cementing, a pack-off bushing may be installed above the fluted casing hanger to seal off the flutes.

A diverter adapter may also be connected to the conductor pipe. The adapter typically has slips at a lower end that can engage the outer diameter of the conductor pipe at a point below the installed landing ring.

Due to loss of cement circulation during cementing operations, sometimes topping up cement through the radial space between the landing ring and fluted mandrel hanger is necessary. In some cases, the radial space between the landing ring and hanger is not big enough to allow cement tubing, commonly know as "wash" piping used in such topping up operations to run through. Therefore, topping up cement requires more work and takes more time. Occasionally, the well is abandoned if the cement bonds poorly. Typically, the space between the mandrel hanger and the landing ring does not allow for anything other than small coil tubing. To try and prevent this and allow for larger cement tubing, a larger size casing and larger landing ring can be utilized to provide additional clearance and allow cement topping up. Also, a side entrance may be formed in conductor to do cement topping up. These techniques however, dramatically increase cost.

An improved technique for topping up cement without the need for larger casing is therefore desired.

SUMMARY

In an embodiment of the invention, a surface wellhead assembly may comprise a landing ring and mandrel type casing hanger that are installed at an upper portion of a cemented conductor pipe or conduit. The landing ring has a downward facing shoulder that rests on an upward facing rim of the upper portion of conductor piping. The casing hanger may have flutes disposed about an exterior surface and is supported by the landing ring. The flutes may be welded onto or threaded to the hanger. In this embodiment, a threaded interior, lower portion of the casing hanger may threadingly engage an upper portion of a conductor or casing to thereby support the casing, which may be a tubular conduit or member. The hanger transfers the load of the casing to the conductor pipe via the landing ring.

In this embodiment, the landing ring may have at least one scallop groove formed on an interior of the ring. The landing ring interfaces with a fluted mandrel easing hanger such that the scallop groove advantageously aligns between flutes of the hanger. This alignment occurs for any orientation of the mandrel hanger with the landing ring. This alignment of the scallop groove of the landing ring with the fluted mandrel casing hanger advantageously provides clearance needed to allow a stabbing in of a tubing string for cement injection during cement topping operations or debris clean out down hole.

BRIEF DESCRIPTION OF THE DRAWINGS

FIG. 2 is a side sectional view of an embodiment of the mandrel hanger, in accordance with the invention.

FIG. 3 is a top view of the mandrel hanger of FIG. 2.

DETAILED DESCRIPTION OF THE INVENTION

Figure 1:
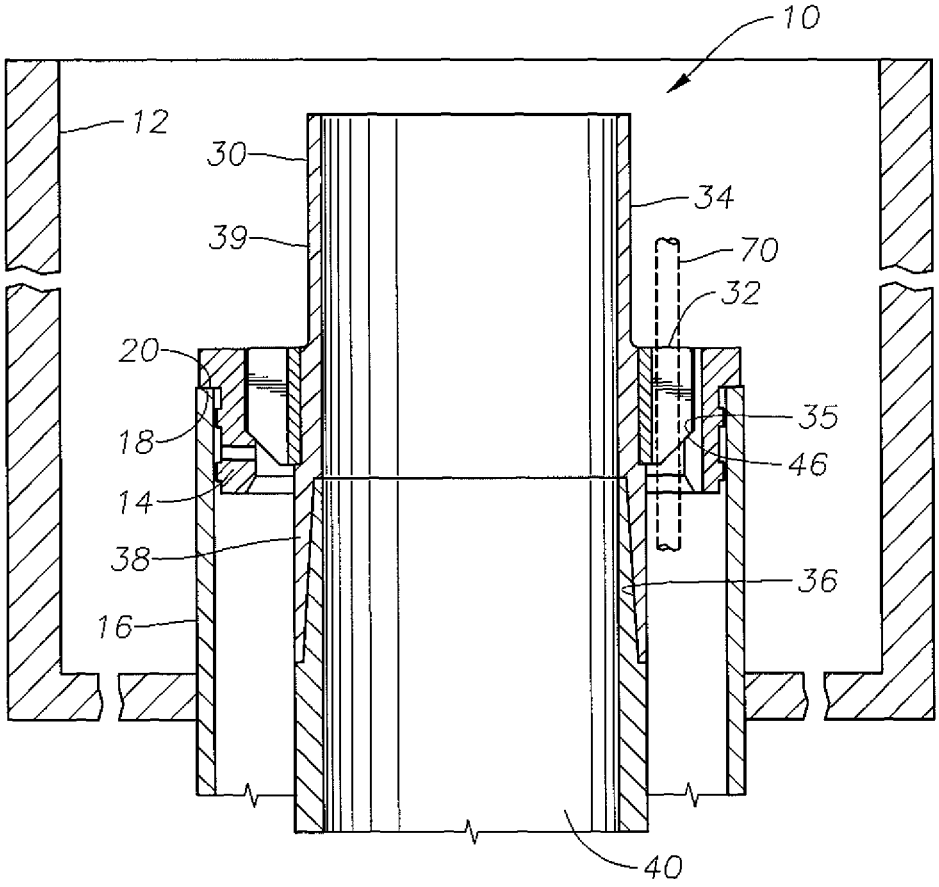
FIG. 1 is a partial sectional view of an embodiment of a mandrel hanger and landing ring installed in a wellhead housing, in accordance with the invention.

Referring to FIG. 1, an illustration of an embodiment of a surface wellhead assembly 10 is shown. The surface wellhead assembly 10 may be located within a cellar 12 constructed around a well hole. The surface wellhead assembly 10 in this embodiment may comprise a landing ring 14 that is installed on an upper portion of a conductor pipe or conduit 16 that extends upward above a base of the cellar 12. The conductor pipe 16 is typically cemented in place with the upper portion extending above the surface. The upper portion of the conductor pipe 16 extending above the surface may be housed in the cellar 12. An outer diameter of the conductor pipe 16 may be sealed against the base of the cellar 12. Conductor pipe 16 is typically used to prevent the sides of the well hole from caving in. The conductor pipe 16 may also be called a drive pipe that is typically short in length and is sometimes driven into the ground.

The landing ring 14 in this embodiment has a downward facing shoulder 18 that rests on an upward facing rim 20 of upper portion of conductor pipe 16. The landing ring 14 will be discussed further below. The surface wellhead assembly 10 may further comprise a mandrel type casing hanger 30 having protrusions or flutes 32 disposed about an exterior surface 34. In this embodiment, at least a portion of a lower end of the flutes 32 on the casing hanger 30 contact an upward facing internal shoulder 35 formed on the landing ring 14 to thereby support the casing hanger 30. Although eight flutes 32 are shown in this embodiment (FIG. 3), more or fewer flutes 32 may be disposed on the casing hanger 30. In this example, the casing hanger 30 has a threaded interior 36 at a lower portion 38. The lower portion 38 of the casing hanger 30 may have a larger outer diameter than an upper portion 39 of the hanger 30. The threaded interior may threadingly engage an upper portion of a casing 40 to thereby support the casing 40. The hanger 30 transfers the load of the casing 40 to the conductor pipe 16 via the landing ring 14. When installed, the lower portion 38 of the casing hanger 30 may protrude downward past the landing ring 14.

Referring to FIGS. 2 and 3, an embodiment of a side sectional view and top view of the mandrel casing hanger 30 shown in FIG. 1, with axis Ax are shown, respectively. In this embodiment, the plurality of flutes 32 may be pact of an annular member or inner ring 49 having an inner diameter that allows annular member to fit over hanger 30. The annular member 49 may be secured to hanger 30 via an internal thread on annular member that may engage a corresponding thread on a portion of exterior surface 34 of the hanger. Alternatively, the plurality of flutes 32 may be integral with hanger 30 or welded onto hanger. A gap 42 (FIG. 3) is thus defined by the spacing of the flutes 32. The flutes 32 in this embodiment are tapered, with an outer portion 43 that is wider than an interior portion 44. The flutes 32 in this embodiment have a height 45 (FIG. 2) and an inclined lower surface 46 (FIG. 2). The inclined surface 46 inclines relative to the axis Ax. The inclined surface 46 meets a downward facing shoulder 48 at lower end of the flute 32. At least a portion of the downward facing shoulder 48 comes in contact with the upward facing internal shoulder 35 of the landing ring 14 (FIGS. 1 and 3). Alternatively, the flutes 32 could have flat upper and lower ends. In this embodiment, the flutes 32 are axially located at about the mid-length of the hanger 30 as shown in FIG. 2.

Figure 4:
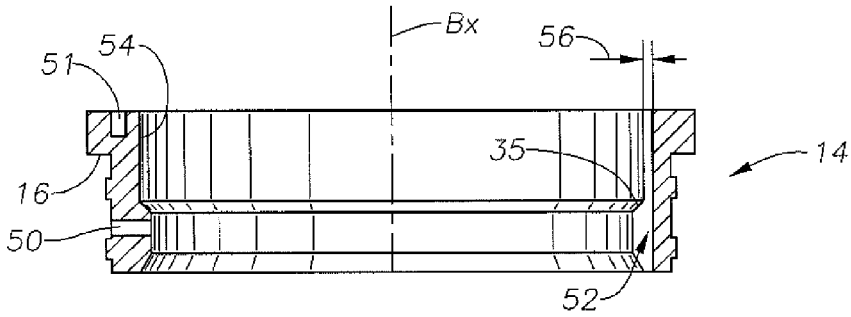
FIG. 4 is a side sectional view of an embodiment of the landing ring, in accordance with the invention taken along a line 4-4 of FIG. 5.
Figure 5:
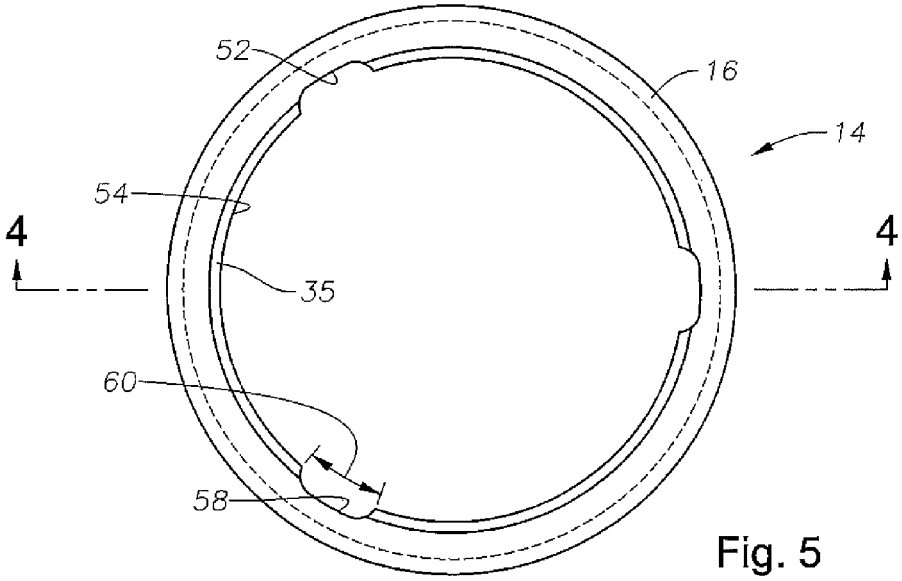
FIG. 5 is a top view of the landing ring of FIG. 4.
Figure 6:
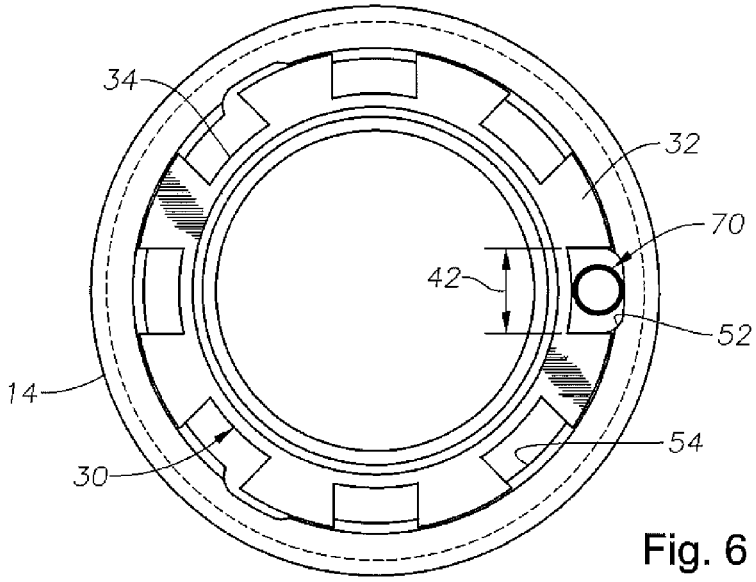
FIG. 6 is a top view of an embodiment of the mandrel hanger and landing ring aligned to allow stabbing of cement tubing string, in accordance with the invention.

Referring to FIGS. 4 and 5, of a side sectional view and top view of the landing ring 14 are shown, respectively. The landing ring 14 has an axis $B_x$ and may have set screw passages 50 to allow set screws (not shown) to be installed to secure the landing ring 14 to the conductor pipe 16 (FIG. 1). The screw passages 50 in this embodiment communicate the inner diameter with the outer surface of the landing ring 14. Further, holes 51 at top of landing ring 14 allow hooks to be secured for hoisting and handling. As previously explained, the upward facing shoulder 35 supports the mandrel casing hanger 13 via contact with the downward facing surface 46 formed on the lower end of flutes 32 (FIGS. 2 and 3). In this embodiment, the landing ring 14 has three recesses or scallops 52 (FIG. 5) formed on an interior surface 54 of the landing ring 14. Alternatively, more or fewer scallops 52 may be formed on the interior surface 54 of the landing ring 14. The scallops 52 are circumferentially spaced equidistant from each other in this embodiment and have a radial outward depth 56 (FIG. 4). An interior surface 58 of each of the scallops 52 is generally curvilinear. A width 60 of each of the scallops 52 is about equal to the gap 42 between the flutes 32 of the mandrel casing hanger 30 (FIG. 6). Each scallop 52 extends from the upper end of lancing ring 14 to the bottom end of landing ring 14. Each scallop 52 extends through shoulder 35, removing part of shoulder 35.

Referring to FIG. 6, a top view of the mandrel hanger 30 landed on the landing ring 14 below is illustrated. As previously described, scallops 52 are circumferentially spaced equidistant from each other on the interior surface 54 of the landing ring 14. This arrangement of the scallops 52 on the landing ring 14 allows at least one of the gaps 42 between the flutes 32 to align at least one of the scallops 52 on the landing ring 14 regardless how the mandrel casing hanger 30 is oriented. Alignment of the scallop 52 with the gap 42 between the flutes 32 of the hanger 30 provides sufficient clearance for a cement fill-up tube 70, also known as a "wash" pipe, to be stabbed into the space of the scallop 32. The cement fill-up tube 70 may be run from the upper portion of the conductor pipe 16 down through the landing ring 14 and installed radially outside of the surface casing string 40 (FIG. 1). When the cement tubing string 70 is stabbed into place, cement can be injected into the annulus below the landing ring 14 during cement topping operations. Further, the tubing string 70 may be used for debris clean out down hole. Depending on cement losses in initial cementing operation, the cement tubing string 70 could be run down to depth of about 20 meters or more below the surface in order to reach the previous cement top. Depending on the size of annulus, a cement tube string 70 may have an inner diameter size of up to 2 inches. Although this embodiment shows a combination of three scallops 52 with eight gaps 42, several other combinations can also provide the required clearance for cement fill-up tubing 70. The combination of scallops and gaps to allow for alignment of at least one scallop with a gap may vary with several factors, including the size of cement fill-up tubing, size of the mandrel hanger, size of the landing ring, and size of the conductor pipe.

Figure 7:
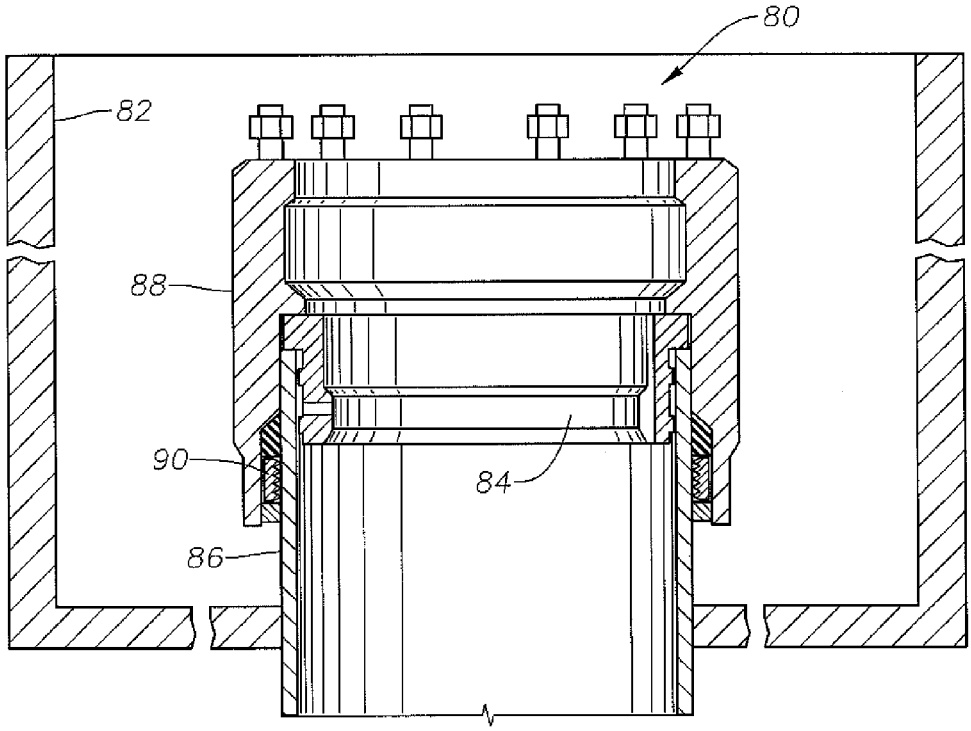
FIG. 7 is a partial sectional view of an alternative embodiment of a landing ring and diverter adapter installed on a conductor pipe.
Figure 8:
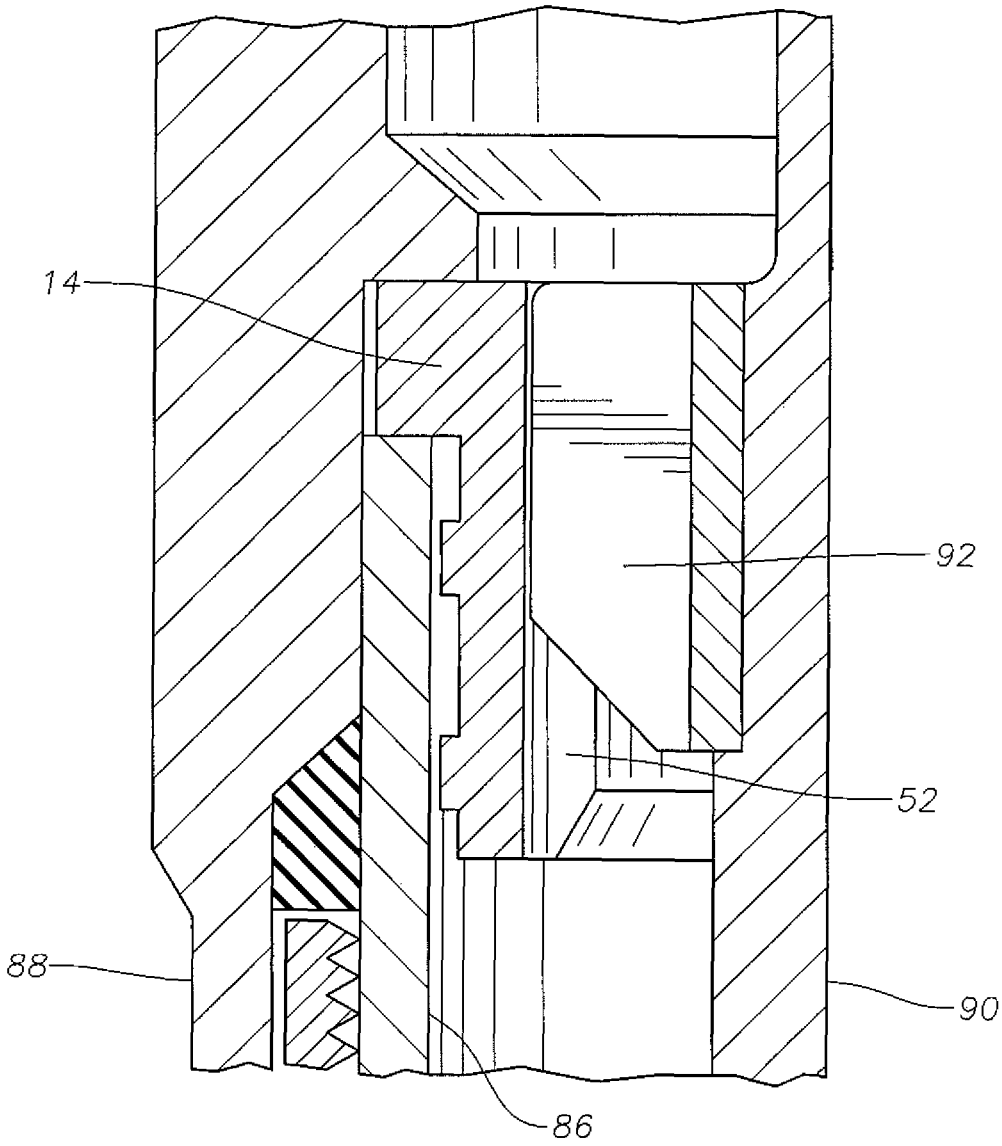
FIG. 8 is an enlarged partial sectional view of a portion of the assembly shown in FIG. 7.

In another embodiment, shown in FIGS. 7 and 8, a surface well assembly 80 is shown installed within a cellar 82. The surface well assembly 80 in this embodiment includes a landing ring 84 installed at an upper extending end of a conductor pipe 86. A diverter adapter 88 is installed over the upper extending end of the conductor pipe 86 such that slips 90 in an internal profile of the diverter adapter 88 engage outer surface of the conductor pipe 86. In this embodiment, the diverter adapter 88 encloses the entire landing ring 84. The diverter adapter 88 can be used to provide a connection or mounting point for a diverter (not shown), which can be utilized to control well pressure. For clarity, a hanger is not shown in FIG. 7 but could be landed on landing ring 84 as described in a previous section. Landing ring 84 has scallops (not shown) the same as scallops 52 in FIG. 5. Flutes (not shown) are formed on the inner diameter of diverting adapter 88. FIG. 8 is enlarged partial sectional view of a portion of the assembly shown in FIG. 7 and includes a mandrel casing hanger 90 with flutes 92, similar to hanger 30 in FIGS. 1-3.

Referring to FIG. 1 again, during installation the conductor pipe 16 is typically cut to a desired height and leveled off. The landing ring 14 is then installed such that the downward facing shoulder rests on the rim of the upper portion of the conductor pipe. Set screws may be installed into place through the screw passages 50 in the landing ring wall and into contact with inner diameter of conductor pipe 16 to secure the landing ring 14 to the conductor pipe. The fluted mandrel hanger 30 and connected casing 40 may then landed on landing ring 14 such that the downward facing lower surface 46 of the flute 32 rests on the upward facing internal shoulder 35 of the landing ring 14. Casing weight is thus transferred to conductor pipe 16 via hanger 30. Cement may be pumped down through casing and up through annulus, allowing cement to flow up past the flutes 32 of the hanger 30. If cementing requires topping off, the scallops 52 (FIG. 5) formed on interior of landing ring 14 are aligned with at least one gap between flute 32 such that there exists sufficient space between flutes to allow the cement fill-up tube 70 (FIG. 6) to then be stabbed into clearance formed by the scallop on the landing ring and flutes. Cement can then be pumped into the annulus via the cement line 70.

While the invention has been shown in only one of its forms, it should be apparent to those skilled in the art it is not so limited but is susceptible to various changes without departing from the scope of the invention.

The invention claimed is:

1. A surface wellhead assembly for cementing casing, comprising:

a landing ring adapted to be secured to an upper end of a wellbore casing, the landing ring having a downward facing shoulder on an outer surface for landing on a rim of the casing, the landing ring having an internal upward facing shoulder;

a casing hanger adapted for supporting casing and having an axis;

a plurality of flutes disposed equidistant from each other on an exterior surface of the casing hanger;

a plurality of gaps defined by space between each of the flutes on the casing hanger; and at least one axially extending groove formed on an interior surface of the landing ring that aligns with at least one of the gaps between the flutes on the casing hanger to provide a cement tube passage for a fill up cement tube to stab into the space of the groove.

2. The wellhead assembly of claim 1, wherein at least one groove extends through the upward-facing shoulder on the landing ring.

3. The wellhead assembly of claim 1, wherein the flutes are portions of an annular member welded to the exterior surface of the casing hanger.

4. The wellhead assembly of claim 1, wherein the flutes are joined to an inner annular member that is secured to the exterior surface of the casing hanger.

5. The wellhead assembly of claim 1, wherein the flutes have an outer surface that is wider circumferentially than a circumference width of an inner surface of the flute.

6. The wellhead assembly of claim 1, wherein the at least one groove formed on the interior surface of the first wellhead member has a circumferential width about equal to a circumferential width of the gap between the flutes on the casing hanger.

7. The wellhead assembly of claim 1, wherein the flutes on the casing hanger have a lower surface for landing on the internal upward facing shoulder of the first wellhead member for transferring casing load to the conduit.

8. The wellhead assembly of claim 1, wherein cement tube passage is adapted to provide access to an annulus between the casing hanger and the wellbore casing.

9. The wellhead assembly of claim 1, wherein a diverter adapter is adapted to be landed on the downward facing shoulder of the landing ring.

10. The wellhead assembly of claim 1, wherein the gaps and the scallops are about 1½ times the diameter of the fill up cement tube.

11. An apparatus for cementing casing at a surface well, comprising:

a landing ring adapted to be secured to an upper end of a conductor pipe, the landing ring having a downward facing shoulder on an outer surface for landing on a rim of the upper end of the conductor pipe, the landing ring having an internal upward-facing shoulder;

a mandrel hanger adapted having a lower threaded portion for engaging an upper end of a casing to thereby support casing, the hanger having an axis;

a plurality of flutes disposed equidistant from each other on an exterior surface of the mandrel hanger and extending radially outward from the hanger, the flutes having lower ends that land on the upward facing shoulder of the landing ring to allow for transfer of a casing load from the mandrel hanger to the landing ring and to the conductor pipe;

a plurality of gaps defined by spaces between adjacent ones of the flutes on the mandrel hanger; and at least one axially extending groove formed on an interior surface of the landing ring that aligns with one of the gaps between the flutes on the mandrel hanger to provide a cement tube passage for a cement tube to stab through the cement tube passage, the groove extending from an upper end to a lower end of the landing ring;

wherein the at least one groove formed on the interior surface of the landing ring has a circumferentially extending width about equal to a circumferentially extending width of the gap between the flutes on the mandrel hanger.

12. The apparatus of claim 11, wherein said at least one groove comprises a plurality of grooves and a there are more of the flutes than the grooves.

13. The apparatus of claim 11, wherein at least one groove extends through the upward-facing shoulder on the landing ring.

14. The apparatus of claim 11, wherein the at least one groove formed on the interior surface of the first wellhead member has a circumferential width about equal to a circumferential width of the gap between the flutes on the mandrel hanger.

15. The wellhead assembly of claim 11, wherein the gaps and the scallops are about 1½ times the diameter of the cement tube.

16. The wellhead assembly of claim 11, wherein cement tube passage is adapted to provide access to an annulus between the casing hanger and the wellbore casing.

17. A method of cementing a casing, comprising:

providing a landing ring adapted to be secured to an upper end of a wellbore casing, the landing ring having a downward facing shoulder on an outer surface for landing on a rim of the casing, the landing ring having an internal upward facing shoulder, a casing hanger adapted for supporting casing and having an axis, a plurality of flutes disposed equidistant from each other on an exterior surface of the casing hanger, a plurality of gaps defined by space between each of the flutes on the casing hanger; and at least one axially extending groove formed on an interior surface of the landing ring that aligns with at least one of the gaps between the flutes on the casing hanger to provide a cement tube passage for a fill up cement tube to stab into the space of the groove, landing the casing hanger on the internal upward facing shoulder of the landing ring and aligning hanger with the landing ring so that the gap formed between a plurality of flutes on the casing hanger aligns with the at least one groove on the landing ring; and stabbing the cement tube past the landing ring through a space defined by the at least one groove on the landing ring and the gap between the flutes.

18. The method of claim 17, further comprising:

pumping cement during a primary pumping operation down a casing supported by the casing hanger and up an annular space outside of the casing; and pumping cement during a topping off operation down the cement tube to a point below the landing ring and in the annular space outside the casing to top off cement.

* * * * *